United States Patent [19]

Takahashi et al.

[11] 4,243,414

[45] Jan. 6, 1981

[54] SLIDABLE MEMBERS FOR PRIME MOVERS

[75] Inventors: Kentaro Takahashi; Yoshikatsu Nakamura, both of Ohmiya; Masajiro Takeshita, Yono, all of Japan

[73] Assignee: Nippon Piston Ring Co., Ltd., Tokyo, Japan

[21] Appl. No.: 955,445

[22] Filed: Oct. 27, 1978

[30] Foreign Application Priority Data

Oct. 27, 1977 [JP] Japan ..... 52-128120

[51] Int. Cl.[3] ..... B22F 5/00

[52] U.S. Cl. ..... 75/244; 75/200; 75/222; 75/126 P; 75/126 R; 75/126 A; 75/126 Q

[58] Field of Search ..... 75/200, 222, 126 P, 75/126 R, 126 A, 126 Q, 244

[56] References Cited

U.S. PATENT DOCUMENTS

| | | | |
|---|---|---|---|
| 2,370,124 | 2/1945 | Charlton | 75/126 R |
| 3,227,544 | 1/1966 | Rowady | 75/126 P |
| 3,275,426 | 9/1966 | Rowady | 75/126 Q |
| 3,577,226 | 5/1971 | Elbert et al. | 75/222 |
| 3,674,472 | 7/1972 | Kimura et al. | 75/20 BR |
| 4,035,159 | 7/1977 | Hashimoto et al. | 75/200 |
| 4,043,843 | 8/1977 | Tanczyn | 75/126 Q |

*Primary Examiner*—Brooks H. Hunt

*Attorney, Agent, or Firm*—Sughrue, Rothwell, Mion, Zinn and Macpeak

[57] ABSTRACT

A slidable member for a prime mover made of an abrasion resistant liquid-phase sintered alloy, containing 0.5 to 4.0% by weight of carbon, 8.0 to 30.0% by weight of chromium, and 0.1 to 5.0% by weight of at least one of phosphorus, boron and silicon which permit liquid-phase sintering at not more than 1,250° C., and the balance iron. The sintered alloy has 0.2 to 10% by volume of sintering pores at least 40% of which consist of pores having a pore size of not more than 150μ.

4 Claims, 3 Drawing Figures

SLIDABLE MEMBERS FOR PRIME MOVERS

BACKGROUND OF THE INVENTION

1. Field of the Invention

This invention relates to a slidable member for prime movers. More specifically, it relates to a slidable member for prime movers under high planar pressures (hereinafter "slidable member") for use in internal combustion engines, compressors, etc. It is a slidable member which has sufficient durability (i.e., long useful life, high wear resistance, high mechanical fatigue strength) even when subjected to high planar pressures.

2. Discussion of the Prior Art

Generally, sintered alloy materials are frequently used as slidable members at low planar pressures, and very few are used at high planar pressures. While in one embodiment of the present invention the slidable member is used as a material for the slidable surface of a rocker arm for an internal combustion engine, the invention is not limited to this utility alone.

The rocker arm of an overhead cam shaft-type internal combustion engine is made of cast iron. As examples of cast iron rocker arms, there are those in which the surface in sliding contact ("the sliding surface") with the cam of the cam shaft is chilled, there are also those having a chrome-plated slidable surface, and those having a slidable surface coated with a self-fusing alloy by flame spraying. Because the slidable surface of the rocker arm is subjected to high planar pressures, its durability poses a difficult problem.

SUMMARY OF THE INVENTION

The present invention is the result of extensive efforts made to develop excellent slidable component parts for use at high planar pressures.

A primary object of this invention is to provide a slidable member having excellent durability under high planar pressures.

DETAILED DESCRIPTION OF THE INVENTION

Figure 1:
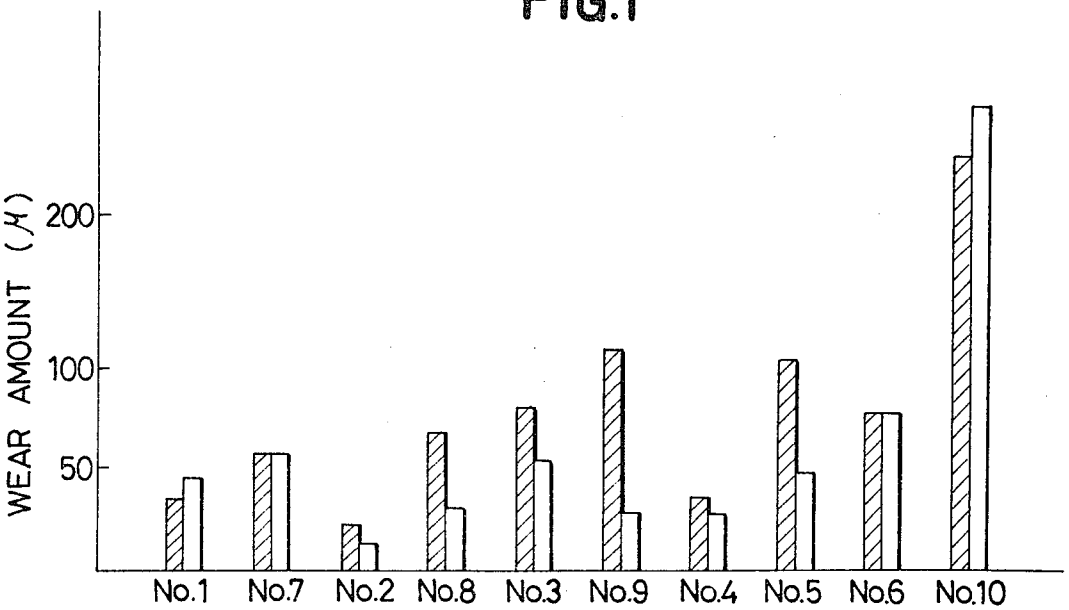
FIG. 1 is a graph showing the amounts of wear in an engine test of a rocker arm produced from the abrasion resistant sintered alloy in accordance with this invention.

The slidable member of this invention is characterized by an alloy composition containing 0.5 to 4.0% by weight of carbon, 8.0 to 30.0% by weight of chrominum, and 0.1 to 5.0% by weight of at least one of phosphorus, boron and silicon which permit sintering at temperatures not higher than 1,250° C., and the balance iron, and having 0.2 to 10% by volume of sintering pores at least 40% of which consist of pores having a pore size of not more than 150 $\mu$. In other embodiments the invention is characterized by an alloy composition comprising in addition to iron, carbon, chromium and the phosphorus, boron, silicon component (1) not more than 10% by weight of one of Ni, Cu, Co and W metals, (2) not more than 20% by weight of Mo, or (3) not more than 20% by weight of at least two of Ni, Mo, Cu, Co and W metals, and 0.2 to 10% by volume sintering pores at least 40% of which consist of pores having a pore size of not more than 150 $\mu$.

The activity of the various individual components of the slidable member of this invention and the reasons for limiting their amounts are explained below.

Carbon is necessary for strengthening the substrate, forming a precipitation hardened phase (Fe containing chromium carbide) and abrasion resistance is imparted to the slidable member. Carbon reacts with chromium in the alloy composition to precipitate a hard carbide phase which imparts wear resistance to the sliding surface. The reason for the limiting the amount of carbon as an alloy component is as follows. If the amount of carbon is less than 0.5% by weight, the amount of the pecipitation hardened phase is inadequate, excellent wear resistance is not obtained. The alloy cannot satisfactorily endure abrasion and wear under high planar loads. Furthermore, a high strength substrate is not obtained. On the other hand, the amount of the precipitation hardened phase is directly proportional to the amount of carbon in the system, hence if the amount of carbon exceeds 4.0% by weight, the precipitation hardened phase becomes too large, and the alloy becomes brittle.

Slidable component parts used at high planar pressures tend to undergo pitting. Pitting is a fatigued phenomenon caused by repeated loads during sliding. Slidable members made of sintered alloy obtained by usual solid-phase sintering have many pores and therefore have low strength. Hence, such slidable members undergo pitting wear under repeated loads. Pitting resistance is increased by making a slidable member of sintered alloy subject to high planar pressures by liquid-phase sintering. Liquid-phase sintering can be performed at higher temperatures. However, in view of the durablility of the sintering furnace, it is necessary to generate a sufficient liquid-phase amount at temperatures not more than 1,250° C. Phosphorus, boron, silicon are effective because they are elements which permit liquid-phase sintering at not more than 1,250° C. When the amount of at least one of phosphorus, boron and silicon is less than 0.1%, the amount of liquid-phase is too small and increase in strength cannot be obtained. On the other hand, when the amount of at least one of phosphorus, boron and silicon is greater than 5.0%, the amount of liquid-phase becomes too large and a sintered body having a high dimensional accuracy cannot be obtained.

For the above reason, at least one of phosphorus, boron and silicon is used in an amount of 0.1 to 0.5% by weight. The amount of addition is inversely proportional to the sintering temperature.

Chromium is important for strengthening the substrate and combining with carbon to form the precipitation hardened phase as explained. When the amount of chromium is less than 8% by weight, the amount of the precipitation hardened phase is inadequate, on the other hand when the amount of chromium exceeds 30% by weight, no marked increase in abrasion resistance is noted, and the increased amount of chromium only increases the price of the member. Furthermore, the resulting alloy has reduced machineability.

Regarding the porosity, if the porosity exceeds 10% by volume, sintering is insufficient, and the bond strength amongst the particles is weak. Thus, the resulting alloy is susceptible to fatigue and tends to induce pitting wear. Furthermore, its mechanical strength is degraded. Accordingly, porosity is limited to not more than 10% by volume. If it is less than 0.2% by volume, there are too few oil pools, the product has poor oil retention and is susceptible to scuff wear. The importance of pores is evident from the fact that a solution of the same components cannot give the expected properties.

Desirably, the pores are fine and are dispersed uniformly. When the pore size is more than 150 μ and the porosity is less than 10% by volume, the pores are not uniformly present and the oil retention of the product is very poor. Accordingly, for the same reason, scuff wear tends to occur if fine pores having a size of not more than 150 μ are present in an amount of less than 40%.

For the foregoing reason, the slidable member of this invention should comprise, in addition to iron, 0.5 to 4.0% by weight of carbon, 8.0 to 30.0% by weight of chromium and 0.1 to 5.0% by weight of at least one of phosphorus, boron and silicon which permits liquid-phase sintering at not more than 1,250° C. and have 0.2 to 10% by volume of sintering pores at least 40% of which consist of pores having a pore size of not more than 150 μ.

As indicated earlier, the alloy of the present invention is a liquid phase sintered alloy. After compounding powdered raw materials according to the claimed formulations, the powders are molded at pressure of about 2 tons/cm$^2$ to 7 tons/cm$^2$, preferably about 5 tons/cm$^2$. A suitable liquid phase sintering temperature range is about 1,000° to 1,250° C. for the alloy composition used in this invention. The optimum temperature falls within this range but is a function of the amount of phosphorus, silicon or boron in the composition. Generally, sintering is carried out for about 20 to 60 minutes, preferably 45 minutes, in an atmosphere of decomposed ammonia gas, converted propane or under a vacuum.

After sintering, the product is mainly perlite. But the substrate structure can be strengthened depending upon the slidable member with which it is used in manners known in the art. A method for strengthening the substrate structure is to heat-treat the product after sintering to convert it mainly to a bainite or martensite structure. In this case, the pitting resistance of the product increases further. For example, when, after sintering, the product is heated at 870° C. and heat-treated in a salt bath at about 400° C. for about 10 to 40 hours, the substrate structure becomes bainitic. When it is heated at 870° C. and then heat-treated with water or oil at room temperature, the substrate structure becomes martensitic.

Another method for strengthening the substrate structure is to add Ni, Mo, Cu, Co, W, etc. Ni, Mo, Cu, Co and W can be added either alone or as a mixture of two or more. When these materials are used the alloy composition additionally comprises: (1) not more than 10% by weight of one of Ni, Cu, Co and W metals, (2) not more than 20% by weight of Mo, or (3) not more than 20% by weight of at least two of Ni, Mo, Cu, Co and W metals, and have the same sintering pore volume discussed above, at least 40% of which consists of pores having a pore size of not more than 150 μ.

When Ni, Cu, Co and W are added alone, an amount not more than 10% is sufficient. Particularly Ni, Cu, and Co can achieve sufficient strengthening when added in an amount of not more than 10%. From the standpoint of economy, as well, the amount is advantageously limited to not more than 10%. When more than 10% of W is added and used together with another slidable member, the wear of the other slidable member tends to be accelerated. Accordingly, its purpose can be achieved if it is used in an amount of not more than 10%. When Mo is added alone, an amount not more than 20% by weight is sufficient. When it is added in an amount of more than 20% by weight and used in combination with another slidable member, the wear of the other slidable member will be increased. From the standpoint of economy, too, the amount of Mo is advantageously not more than 20% by weight.

When two or more of Ni, Mo, Cu, Co and W are added, the substrate structure can be sufficiently strengthened when the total amount of the elements is not more than 20%. Even in the case of adding alloying elements, heat-treatment after sintering as described above can also be used to strengthen the substrate structure.

The slidable member of this invention has a hardened phase precipitated by the addition of Cr and is rendered highly dense by liquid-phase sintering by the addition of P, B, or Si. It has superior pitting resistance and very good abrasion resistance.

The slidable member of this invention was built, as a slidable member of a rocker arm, and tested on a table by using an internal combustion engine.

EXAMPLE

Powders of raw materials were compounded according to the formulations shown in Table 1. Each of the mixtures was molded at a pressure of 5 tons/cm$^2$, and sintered for 45 minutes in decomposed ammonia gas. Thus, slidable members Nos. 1 to 9 of the invention were obtained.

Comparative member No. 10 (a cast iron rocker arm) was obtained by setting a chilling block on the surface to be in slidable contact with the cam within a mold and pouring a molten mixture of the components into the mold to chill the slidable surface.

TABLE 1

| Sample No. | Composition (wt %) C | P | B | Si | Cr | Ni | Mo | Cu | Co | W | Fe | Sintering Temperature (°C.) | Strengthening treatment | Porosity (%) | % pore size of 150μ or less | Final base structure |
|---|---|---|---|---|---|---|---|---|---|---|---|---|---|---|---|---|
| 1 | 2.5 | 0.5 | — | — | 12.0 | 1.0 | 1.0 | — | — | — | remainder | 1145 | | 0.5 | 99 | bainite |
| 2 | 2.5 | 0.5 | — | — | 16.0 | — | 1.0 | 2.0 | — | — | " | 1145 | heated to 870° C., and thereafter dipped in an oil at room temperature | 2.0 | 85 | martensite*1 |
| 3 | 2.5 | 0.5 | — | — | 10.0 | 1.0 | 10.0 | — | — | — | " | 1125 | | 6.0 | 60 | bainite |
| 4 | 2.0 | 1.0 | — | — | 11.5 | 1.0 | 1.0 | 1.5 | 0.8 | — | " | 1140 | | 4.0 | 90 | bainite |
| 5 | 1.5 | — | 1.0 | — | 10.3 | 1.0 | 2.0 | — | — | — | " | 1160 | | 3.0 | 85 | bainite |
| 6 | 2.5 | 0.3 | — | 2.0 | 11.0 | 1.0 | 1.0 | — | — | — | " | 1140 | heated to 870° C., and thereafter | 2.5 | 95 | bainite*2 |

TABLE 1-continued

| | | | | | | | | | | | | | | | | | |
|---|---|---|---|---|---|---|---|---|---|---|---|---|---|---|---|---|---|
| | | | | | | | | | | | | | | dipped in a salt bath for 20 hours at a temperature of 400° C. | | | |
| 7 | 3.0 | 0.5 | — | — | 17.0 | — | — | — | — | — | " | 1145 | | | 8.0 | 70 | perlite |
| 8 | 1.0 | 1.0 | — | — | 11.0 | — | 8 | — | — | — | " | 1140 | | heated to 870° C., and thereafter dipped in an oil at room temperature | 4.0 | 90 | martensite*3 |
| 9 | 0.6 | 1.5 | — | — | 11.0 | — | — | — | — | 2.0 | " | 1160 | | | 5.0 | 100 | martensite*4 |

*1, 2, 3, 4 show base structure subject to heat treatment.

| | C | Si | Mn | P | S | B | Cu | Cr | Mo | Fe |
|---|---|---|---|---|---|---|---|---|---|---|
| Comparative member 10 | 3.5 | 2.2 | 0.7 | 0.1 | 0.04 | 0.02 | 0.5 | 0.9 | 0.5 | remainder |

Engine Test (1) Operating conditions

Engine tested: Water-cooled series 4-cylinder O.H.C.

Engine speed: 750 rpm—no load

Lubricating oil: SAE 30#

Oil temperature: 50° C.

Operating time: 200 hr (2) Cam shaft:

The material of the cam portion of the cam shaft was perlite which was a chilled cast iron containing 30 to 40% of carbide. It had the following chemical composition.

| Cam shaft tested | Composition (% by weight) | | | | | | | | |
|---|---|---|---|---|---|---|---|---|---|
| | C | Si | Mn | P | S | Cu | Cr | Mo | Fe |
| Chilled cast iron | 3.4 | 2.1 | 0.7 | 0.1 | 0.04 | 0.3 | 0.8 | 0.3 | Balance |

The test results are shown in FIG. 1. In FIG. 1, the hatched portions show the amount of wear of the cam, and the non-hatched portions, the amount of wear of the rocker arm.

Thus, the slidable member of the invention has a hardened phase precipitated by the addition of Cr and is rendered highly dense by liquid-phase sintering upon addition of P, B, Si, etc. It has superior pitting resistance and very good abrasion resistance. As is clear from FIG. 1, the amount of wear is as good and about $\frac{1}{3}$ to 1/5 that of the Comparison.

The slidable members Nos. 1 to 9 of the invention did not develop pitting wear.

Figure 2:
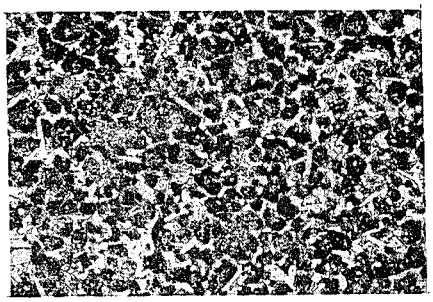
FIGS. 2 and 3 are microphotographs of the structures in the example of the slidable member of the invention.

FIG. 2 is a microphotograph (200×, etched) of the structure of the slidable member No. 7 of the invention. The white phase consists of Fe-Cr carbide and steadite, and the substrate around the white phase is perlite.

Figure 3:
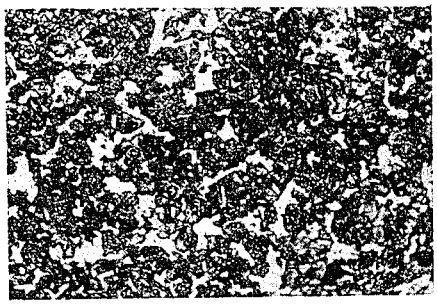

FIG. 3 is a microphotograph (200×, etched) of the structure of the slidable member No. 3 of the invention. As in FIG. 2, the white phase consisted of Fe-Cr carbide and steadite. In this case the substrate around the white phase is bainite.

While the invention has been described in detail and with reference to specific embodiments thereof, it will be apprent to one skilled in the art that various changes and modifications can be made therein without departing from the spirit and scope thereof.

We claim:

1. A slidable member for a prime mover made of an abrasion resistant liquid-phase sintered alloy, containing 0.5 to 4.0% by weight of carbon, 8.0 to 30.0% by weight of chromium, and 0.1 to 5.0% by weight of at least one of phosphorus, boron and silicon which permit liquid-phase sintering at not more than 1,250° C. and the balance iron, said alloy having 0.2 to 10% by volume of sintering pores at least 40% of which consist of pores having a pore size of not more than 150 $\mu$.

2. The slidable member of claim 1, wherein said alloy comprises carbon, chromium, and at least one of phosphorus, boron and silicon; not more than 10% by weight of one of Ni, Cu, Co and W metals and the balance iron.

3. The slidable member of claim 1, wherein said alloy comprises carbon, chromium, and at least one of phosphorus, boron and silicon; and not more than 20% by weight of Mo and the balance iron.

4. The slidable member of claim 1, wherein said alloy comprises carbon, chromium, and at least one of phosphorus, boron and silicon; and not more than 20% by weight of at least two of Ni, Mo, Cu, Co and W metals and the balance iron.

* * * * *